US009078504B2

(12) United States Patent
Crandall

(10) Patent No.: US 9,078,504 B2
(45) Date of Patent: Jul. 14, 2015

(54) CAMERA ACCESSORY CASE HAVING EXPANDABLE HOUSING

(75) Inventor: Kevin Crandall, Santa Rosa, CA (US)

(73) Assignee: DayMen Canada Acquisition ULC, Vancouver (CA)

( * ) Notice: Subject to any disclaimer, the term of this patent is extended or adjusted under 35 U.S.C. 154(b) by 677 days.

(21) Appl. No.: 13/031,039

(22) Filed: Feb. 18, 2011

(65) Prior Publication Data

US 2012/0048849 A1 Mar. 1, 2012

Related U.S. Application Data

(60) Provisional application No. 61/306,439, filed on Feb. 19, 2010.

(51) Int. Cl.

| | |
|---|---|
| ***B65D 30/22*** | (2006.01) |
| ***A45C 11/38*** | (2006.01) |
| ***A45C 7/00*** | (2006.01) |
| *A45C 13/10* | (2006.01) |

(52) U.S. Cl.

CPC ..... *A45C 11/38* (2013.01); *A45C 7/0063* (2013.01); *A45C 13/103* (2013.01)

(58) Field of Classification Search

CPC ..... A45C 11/38

USPC ..... 206/316.1, 316.2, 316.3; 224/908, 224/653–658, 681, 194, 195, 660, 665, 666, 224/671, 672, 674, 675, 677, 230; 383/2, 383/120, 11, 22, 24, 38–40; 229/67.3; 190/103–105, 107–112, 902, 903; 150/116, 113, 135, 148

See application file for complete search history.

(56) References Cited

U.S. PATENT DOCUMENTS

| | | | | |
|---|---|---|---|---|
| 1,090,553 | A * | 3/1914 | Mashek | 190/109 |
| 3,122,225 | A | 2/1964 | Ward | |
| 4,054,167 | A | 10/1977 | Rausch | |
| 4,136,726 | A | 1/1979 | Lee | |
| 4,260,004 | A | 4/1981 | Domke | |
| 4,334,601 | A | 6/1982 | Davis | |
| 4,545,414 | A | 10/1985 | Baum | |

(Continued)

FOREIGN PATENT DOCUMENTS

| | | | |
|---|---|---|---|
| CN | 2857583 | Y | 1/2007 |
| CN | 101268887 | A | 9/2008 |

(Continued)

OTHER PUBLICATIONS

"International Search Report and Written Opinion", Int'l Application No. PCT/US2011/025517, mailed Apr. 19, 2011.

(Continued)

*Primary Examiner* — Jes F Pascua
*Assistant Examiner* — Nina Attel
(74) *Attorney, Agent, or Firm* — Medler Ferro PLLC

(57) ABSTRACT

A camera accessory case includes a main body portion and an expandable housing located within the main body portion. By opening and closing the accessory case, the expandable housing correspondingly expands out of and collapses into the main body portion via a built-in sliding mechanism interconnecting the expandable housing and the main body portion. In addition, the expandable housing may be partitioned into at least two compartments for temporarily housing interchangeable camera lenses, thus facilitating exchange of the interchangeable camera lenses.

12 Claims, 5 Drawing Sheets

(56) References Cited

U.S. PATENT DOCUMENTS

| | | | | | |
|---|---|---|---|---|---|
| 4,610,286 | A | | 9/1986 | Cyr | |
| 4,974,652 | A | * | 12/1990 | Lemler | 150/147 |
| 5,205,448 | A | | 4/1993 | Kester et al. | |
| 5,501,324 | A | | 3/1996 | Franklin et al. | |
| 5,584,424 | A | * | 12/1996 | Stava | 224/240 |
| 5,983,969 | A | * | 11/1999 | Morgan | 150/104 |
| 6,279,804 | B1 | * | 8/2001 | Gregg | 224/675 |
| 6,516,927 | B2 | * | 2/2003 | Krulik | 190/114 |
| 2004/0144819 | A1 | * | 7/2004 | Huang | 224/583 |
| 2006/0283767 | A1 | | 12/2006 | Hassett | |
| 2008/0099523 | A1 | * | 5/2008 | Fan | 224/666 |

FOREIGN PATENT DOCUMENTS

| | | | |
|---|---|---|---|
| CN | 201337062 | Y | 11/2009 |
| WO | 2008/106559 | A1 | 9/2008 |

OTHER PUBLICATIONS

Canon Lens Case LZ1324, www.shop.usa.canon.com.
Kinesis Photo Gear, C380 Small Holster Case, www.kgear.com.
Lowepro Lens Case 1N, www.products.lowepro.com.

* cited by examiner

CAMERA ACCESSORY CASE HAVING EXPANDABLE HOUSING

CROSS-REFERENCE TO RELATED APPLICATIONS

This application is a non-provisional application claiming the benefit under 35 U.S.C. §119(e) of U.S. Provisional Patent Application No. 61/306,439 filed Feb. 19, 2010, which is hereby incorporated by reference in its entirety herein.

FIELD OF THE INVENTION

The invention is related to an apparatus and method for an accessory case having an expandable housing portion therein.

BACKGROUND OF THE INVENTION

Single-lens reflex (SLR) and digital single-lens reflex (DSLR) cameras are high-end, professional cameras that use a semi-automatic moving mirror system to permit the photographer to sometimes see exactly what will be captured by the film or digital imaging system. DSLR and SLR cameras have interchangeable lenses and little shutter lag, allowing photographs to be timed precisely.

When a photographer is attempting to change one interchangeable lens for another interchangeable lens, it is extremely difficult to simultaneously hold the camera and both lenses during the exchange. Further, the interchangeable lenses are both vulnerable to dust and moisture when separated from the camera. Thus, it is desirable for the lens exchange to happen as quickly as possible to avoid exposing the lenses to environmental elements as well as to minimize "down time" and risk missing a picture. Embodiments hereof relate to an accessory case designed to facilitate a lens exchange.

BRIEF SUMMARY OF THE INVENTION

A camera accessory case includes a main body portion and an expandable housing located within the main body portion. By opening and closing the accessory case, the expandable housing correspondingly expands out of and collapses into the main body portion via a built-in sliding mechanism. In addition, the expandable housing may be partitioned into at least two compartments for temporarily housing two interchangeable camera lenses, thus facilitating exchange of the interchangeable camera lenses.

BRIEF DESCRIPTION OF DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention. The drawings are not to scale.

DETAILED DESCRIPTION OF THE INVENTION

Specific embodiments of the present invention are now described with reference to the figures, wherein like reference numbers indicate identical or functionally similar elements. The following detailed description is merely exemplary in nature and is not intended to limit the invention or the application and uses of the invention. Although the description of embodiments hereof are in the context of an accessory case for holding camera accessories, such as lenses, flashes, batteries, cards, etc, the invention may also be used in any other applications where it is deemed useful. Furthermore, there is no intention to be bound by any expressed or implied theory presented in the preceding technical field, background, brief summary or the following

DETAILED DESCRIPTION

Figure 1:
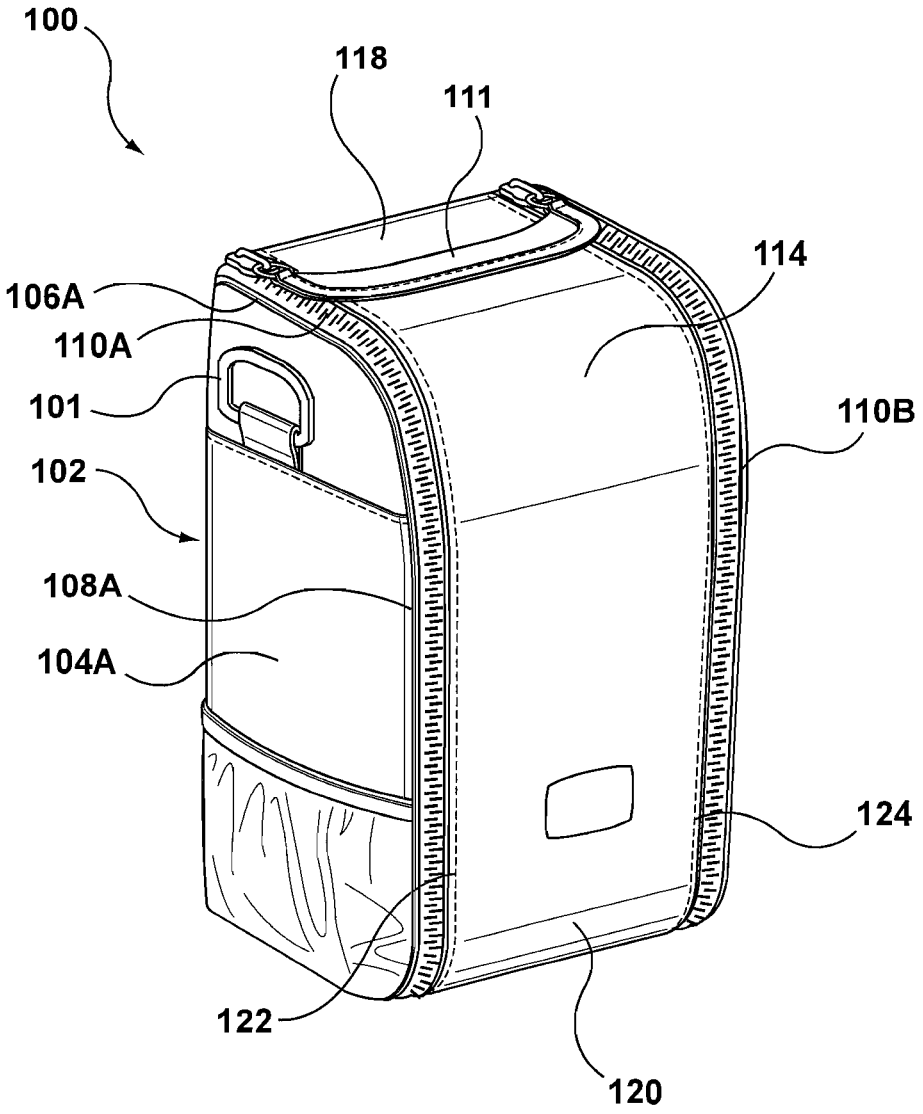
FIG. 1 is a schematic illustration of an accessory case in a closed configuration according to embodiments hereof.
Figure 2C:
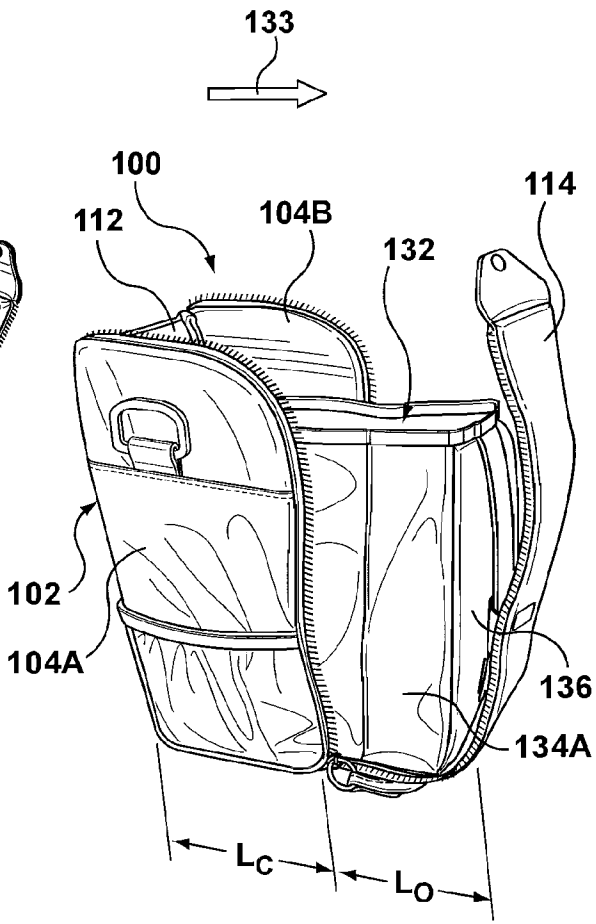
FIGS. 2A, 2B, and 2C are schematic illustrations of the accessory case of FIG. 1 transforming from the closed configuration to an open configuration.
Figure 2B:
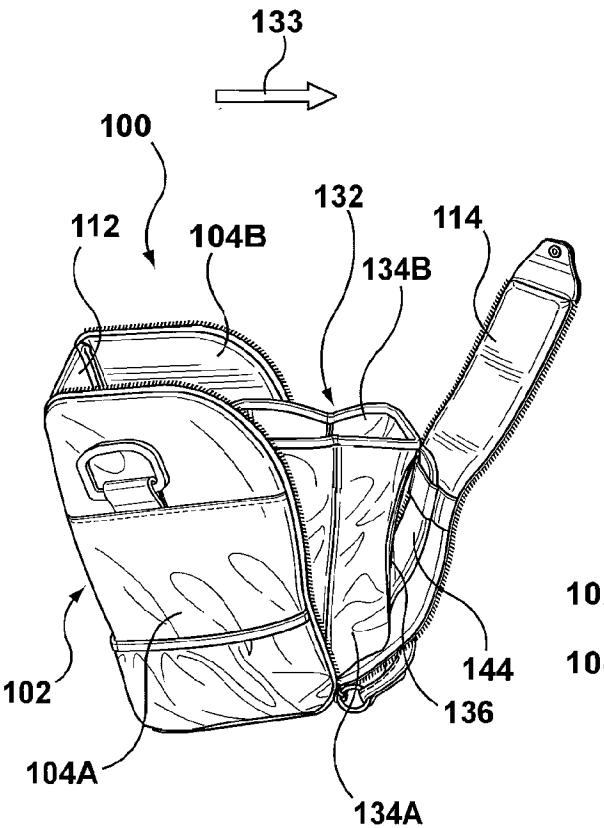
Figure 2A:
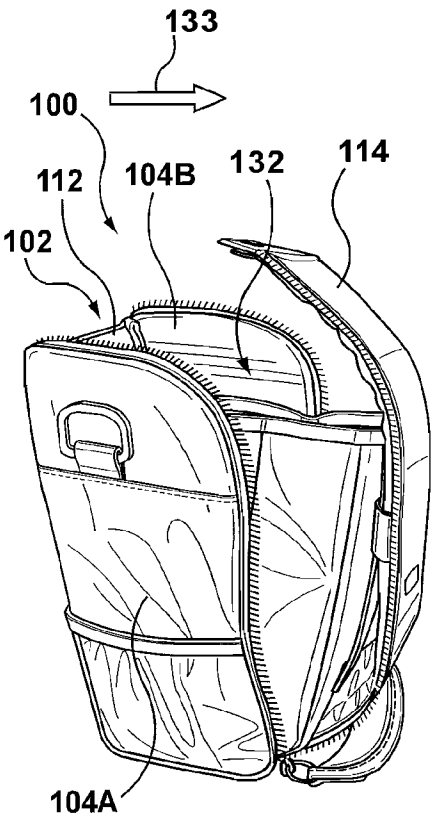

Referring to FIGS. 1 and 2A-2C, embodiments hereof relate to an accessory case 100. Accessory case 100 is described herein for housing camera accessories, particularly interchangeable lenses of a SLR or DSLR camera, and is configured to facilitate the exchanging of the interchangeable camera lenses. However, it should be apparent to one of ordinary skill in the art that accessory case 100 may be utilized for housing other accessories such as electronic accessories, video accessories, personal accessories, and the like and thus is not limited to housing camera accessories. Accessory case 100 includes a main body portion 102 and an expandable housing 132 located within main body portion 102. As will be explained in more detail herein, expandable housing 132 expands out of and collapses into main body portion 102 of accessory case 100 via a built-in sliding mechanism to minimize the overall size of accessory case 100. FIG. 1 is a schematic illustration of accessory case 100 in a closed configuration and FIGS. 2A, 2B, and 2C are schematic illustrations of accessory case 100 transforming to an open configuration.

Main body portion 102 includes a first side panel 104A, a second side panel 104B, a back panel 112, an openable fold-over front panel 114, and a bottom panel (not shown) which collectively define an enclosed interior volume of accessory case 100. All panels of main body portion 102 are relatively planar rectangular structures and preferably are formed from a soft protective material such as nylon or polyester that is capable of protecting camera accessories from impact and shock forces, extreme temperatures, and water damage. Further, in one embodiment, the inner surfaces of one or more panels may include an inner lining of a soft, non-scratch material and/or a thin padding or cross-linked foam of approximately 5 mm thickness to protect the contents stored within accessory case 100. First and second opposing side panels 104A, 104B extend generally parallel to each other and are connected via back panel 112 that extends perpendicularly between the back side edges of side panels 104A, 104B, respectively. In addition, the bottom panel extends perpendicularly between the bottom edges of side panels 104A, 104B and back panel 112. Side panels 104A, 104B, back panel 112, and the bottom panel may be coupled together by stitching or any other appropriate mechanical fastener.

Front panel 114 may open and close like a flap in order to access contents within accessory case 100. Panel 114 includes a continuous elongated planar body having a top end 118 and a bottom end 120 which is secured to the bottom panel of main body portion 102. A first closure mechanism 110A such as a zipper or other sliding fastener couples top and front side edges 106A, 108A, respectively, of side panel 104A to side edge 122 of panel 114. Likewise, a second closure mechanism 110B such as a zipper or other sliding fastener couples edges the top and front side edges (obscured from view in FIG. 1) of side panel 104B to side edge 124 of panel 114. A handle or strap 111 may extend between first closure mechanism 110A and second closure mechanism 110B such that a user may grasp handle 111 with one hand and simultaneously operate, i.e., open and close, closure mechanisms 110A, 110B. In other words, closure mechanisms 110A, 110B may be considered a double zipper and handle 111 may be pulled to open and close front panel 114 for access to the interior of accessory case 100 via one hand.

In addition, accessory case 100 may optionally include one or more loops 101 attached to main body portion 102 for connection to a carrying strap or shoulder. In addition, accessory case 100 may include a belt loop of other mechanism on the back thereof for connection to a belt.

Figure 4:
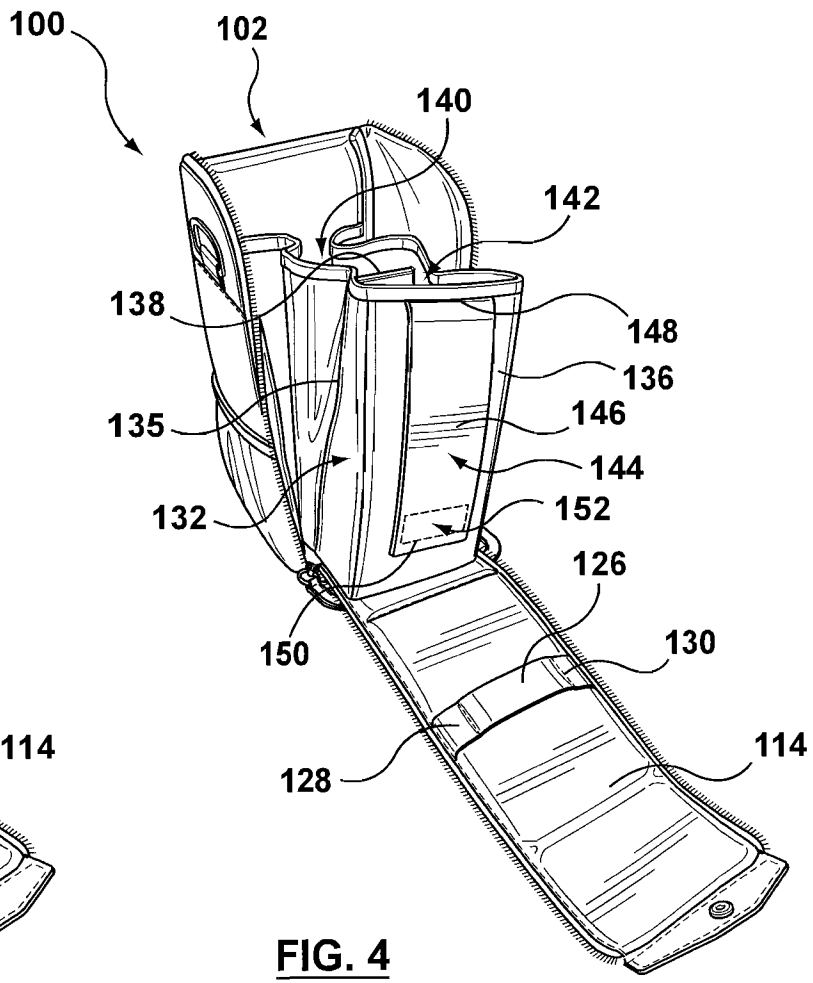
FIG. 4 is a schematic illustration of the accessory case of FIG. 1, with the bottom end of the slider in an unrestrained configuration and attached to an expandable compartment of the case.
Figure 3:
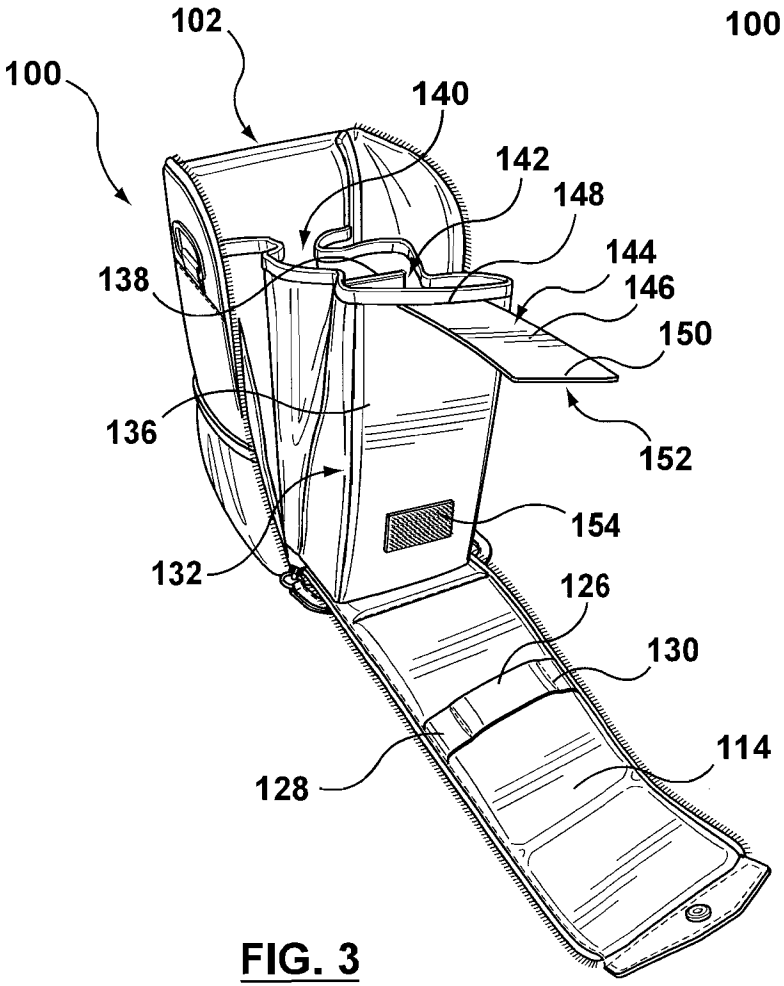
FIG. 3 is a schematic illustration of the accessory case of FIG. 1, with a bottom end of a slider in an unrestrained configuration.

Referring now to FIGS. 2A-2C, expandable housing 132 is located within the interior volume of main body portion 102. When front panel 114 is opened, expandable housing 132 expands out of main body portion 102 of accessory case 100 in the direction of direction arrow 133. Expandable housing 132 includes a first side panel 134A, a second side panel 134B, a front panel 136, and a bottom panel (obscured from view of figures) that is slidable over the bottom panel of main body portion 102. The back edges of side panels 134A, 134B are coupled to back panel 112 of main housing 132, and the front edges of side panels 134A, 134B are coupled to the side edges of front panel 136. As best seen in FIGS. 3 and 4, a divider 138 extends between inner surfaces of side panels 134A, 134B to partition expandable housing 132 into two compartments, a first compartment 140 and a second compartment 142. First compartment 140 is thus defined by back panel 112 of main body portion 103, opposing portions of side panels 134A, 134B of expandable housing 132, and divider 138. Likewise, second compartment 142 is defined by front panel 136 of expandable housing 132, the remaining opposing portions of side panels 134A, 134B of expandable housing 132, and divider 138. In one embodiment, divider 138 extends midway through expandable housing 132 such that the volumes of first and second compartments 140, 142 are approximately equal to each other. As will be explained in more detail herein, the two compartments 140, 142 of expandable housing 132 facilitate the exchange of interchangeable camera lenses with only one hand of a user because each camera lens may be housed in a separate compartment during the exchange thereof. Divider 138 may be attached to the inner surfaces of side panels 134A, 134B via stitching, or by other any mechanical fastener including clips, staples, rivets, adhesive, hook and loop fastener, or the like.

Expandable housing 132 travels in and out of main body portion 102 as front panel 114 of accessory case 100 is opened and closed. When accessory case 100 is closed, an empty compartment of expandable housing 132 (i.e., first compartment 140 or second compartment 142) collapses back into main body portion 102 to minimize the overall size of accessory case 100. More particularly, side panels 134A and 134B of expandable housing 132 are formed from a foldable material. Side panels 134A and 134B each include one or more seams or corners 135 such that when accessory case 100 is closed, side panels 134A and 134B will buckle or pleat at seams 135 and sections of side panels 134A and 134B adjacent to seams 135 will fold together in an accordion-like fashion.

As shown in FIG. 2C, the length (and accordingly the volume) of expandable housing 132 increases from a length $L_C$ when accessory case 100 is closed to a length $L_O$ when accessory case 100 is open. When accessory case 100 is closed, expandable housing 132 has a first volume that is approximately equal to the volume of one compartment of expandable housing 132 (i.e., first compartment 140 or second compartment 142). A camera accessory such as an interchangeable SLR or DSLR camera lens may be stored within accessory case 100 when it is closed. The camera accessory may be stored in either first compartment 140 or second compartment 142, and the empty compartment will collapse into main body portion 102 when accessory case 100 is closed.

When accessory case 100 is opened and expandable housing 132 expands as described above, expandable housing 132 has a second enlarged volume that is equal to the combined volumes of first compartment 140 and second compartment 142. Two camera accessories such interchangeable SLR or DSLR camera lenses may be stored within accessory case 100 when it is opened because one camera lens may be stored within each of first compartment 140 and second compartment 142. As will be explained in more detail herein, such an enlarged volume is particularly advantageous when a user is exchanging interchangeable camera lenses with one hand because the enlarged volume is sufficient to temporarily house both camera lenses.

A sliding mechanism (best shown in FIGS. 3-4) including a slider 144 and a retainer 126 are integrated into accessory case 100 for expanding and collapsing expandable housing 132. Slider 144 is a soft but stiffened flap or panel having an elongated planar body 146 with a top end 148 attached to the top edge of front panel 136 of expandable housing 132 and an unattached bottom end 150. Retainer 126 is essentially a loop formed by a band or strip of material or fabric having ends 128, 130 attached to the inner surface of front panel 114 via stitching or by other any mechanical fastener including staples, rivets, adhesive, hook and loop fastener, or the like. In one embodiment, retainer 126 may be a soft cloth or webbing material or a material having elastic properties.

When accessory case 100 is closed, bottom end 150 of slider 144 is threaded through retainer 126 and then coupled to the outside surface of front panel 136 of expandable housing 132 via mating pieces 152, 154 of a hook and loop type fastener such as VELCRO attached to slider 144 and front panel 136, respectively. Retainer 126 encircles a top portion of slider 144. In FIG. 2A, front panel 114 of main body portion 102 is opened and begins to be pulled or folded backwards. With bottom end 150 of slider 144 still coupled to front panel 136, the pulling or folding movement of front panel 114 effectively opens or expands expandable housing 132 in the direction of directional arrow 133. As front panel 114 is continued to be pulled or folded backwards as shown in FIGS. 2B and 2C, retainer 126 slides along the length of slider 144 in a downward direction towards bottom end 150 of slider 144. FIG. 2C illustrates accessory case 100 in an open configuration such that the interior volumes of compartments 140, 142 are fully accessible. As shown, when accessory case 100 is opened, slider 144 remains threaded though retainer 126 and bottom end 150 of slider 144 remains coupled to front panel 136 of expandable housing 132. When it is desired to close accessory case 100, retainer 126 slides along the length of slider 144 in an upward direction towards top end 148 of slider 144 until front panel 114 folds over and closes accessory case 100. If bottom end 150 of slider 144 becomes uncoupled from front panel 136 when accessory case 100 is being opened, a user may simply reattach mating pieces 152, 154 of slider 144 and front panel 136, respectively, in order to allow retainer 126 to slide along the length of slider 144 when accessory case 100 is being opened and closed.

In another embodiment (not shown), bottom end 150 of slider 144 may be coupled to from panel 136 by stitching or other non-removable mechanical fastener rather than via a hook and loop type fastener such as VELCRO. Retainer 126 still operates to slide along the length of slider 144 for efficient expansion and collapse of expandable housing 132.

Figure 6:
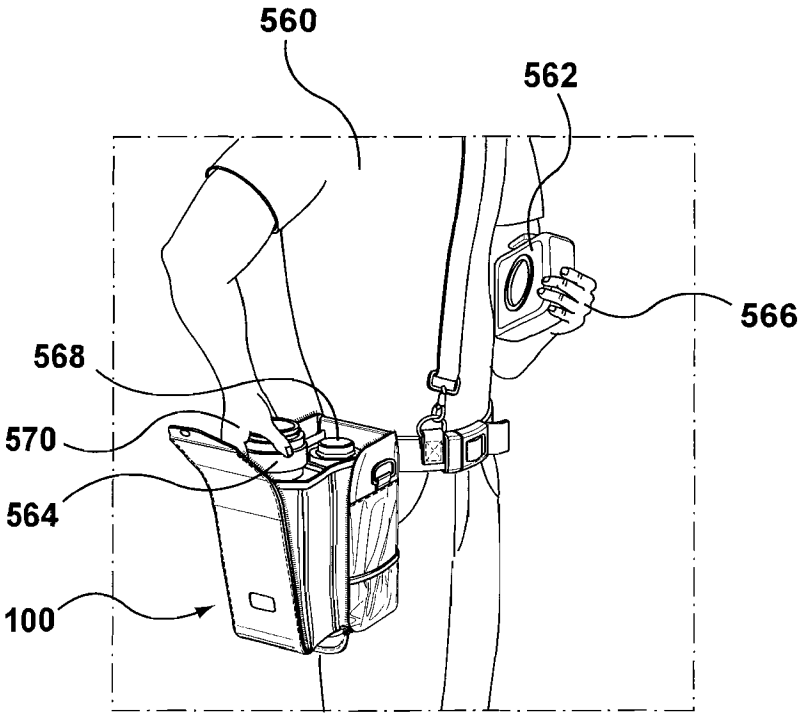
FIGS. 5-8 are schematic illustrations of the accessory case of FIG. 1 being utilized to exchange camera lenses in accordance with an embodiment hereof.
Figure 5:
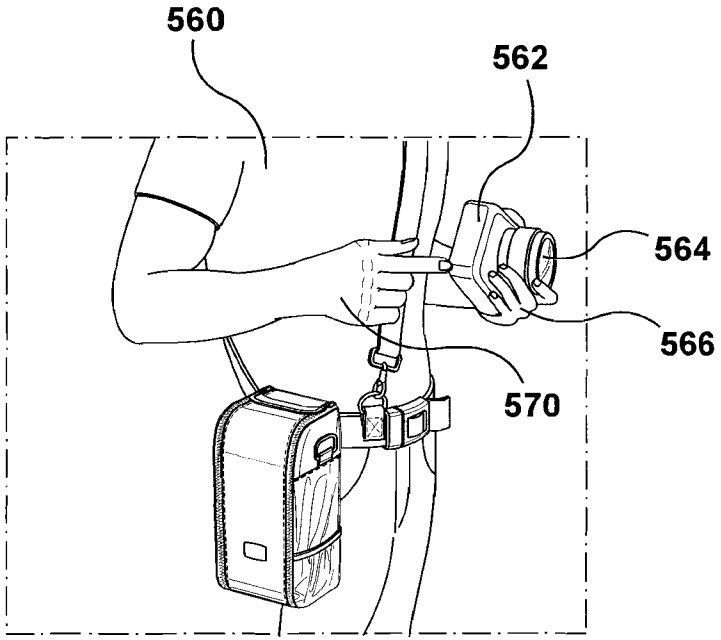
Figure 8:
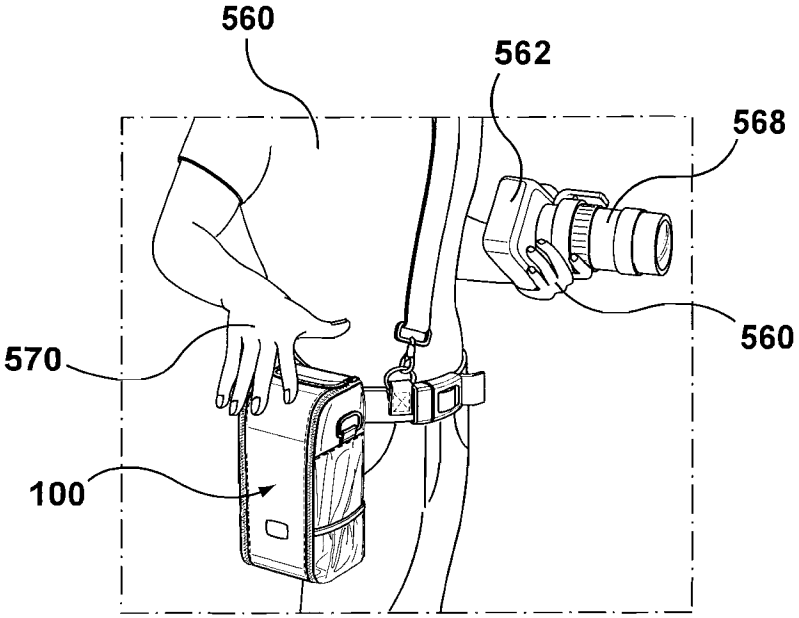
Figure 7:
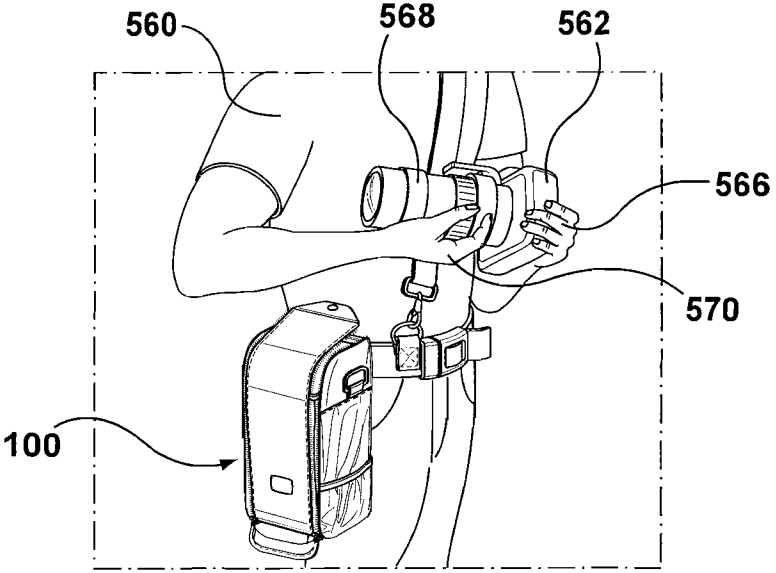

A method of utilizing accessory case 100 to exchange camera lenses will now be described with reference to FIGS. 5-8. As shown in FIGS. 6-8, accessory case 100 may be attached to a belt and/or shoulder strap by any means known in the art. A user 560 holds a camera 562 having a first camera lens 564 in his left hand 566. Accessory case 100 allows user 560 to exchange first camera lens 564 for a second camera lens 568 using only his "free" right hand 570 while continuing to hold camera 562 in his left hand 566. While closed, accessory case 100 has a first volume suitable for housing second camera lens 568 within first compartment 140. With accessory case 100 closed and second camera lens 568 housed within first compartment 140, second compartment 142 of expandable housing 132 is collapsed into main body portion 102. Front panel 114 of accessory case 100 may be opened with the user's "free" right hand 570 utilizing the double zipper closure mechanisms 110A, 110B and handle 111 described above.

Once front panel 114 is opened, expandable housing 132 expands to an enlarged volume as described above and the interior volumes of compartments 140, 142 are fully accessible. Using his "free" right hand 570, user 560 may remove first camera lens 564 from camera 562 and place it into the now accessible second compartment 142 as shown in FIG. 6. The enlarged volume of expandable housing 132 accommodates both second camera lens 568 within first compartment 140 and first camera lens 564 within second compartment 142. The user may then remove second camera lens 568 from accessory case 100 using his "free" right hand 570 and place second camera lens 568 onto camera 562 as shown in FIG. 7.

Referring now to FIG. 8, after the camera lenses are successfully exchanged, user 560 may close front panel 114 of accessory case 100 with his "free" right hand 570 utilizing the double zipper closure mechanisms 110A, 110B and handle 111 described above. Expandable housing 132 collapses into main body portion 102, with first camera lens 564 now housed within second compartment 142. With accessory case 100 closed and first camera lens 564 housed within second compartment 142, first compartment 140 of expandable housing 132 is collapsed into main body portion 102. All of the above described steps of opening accessory case 100, exchanging first camera lens 564 for a second camera lens 568, and closing accessory case 100 may be performed with only the user's "free" right hand 570 such that the user's left hand 566 may continuously hold camera 562. As would be understood by those skilled in the art, references to the left and right hands of the user may be interchanged depending on the location of the accessory case.

While various embodiments according to the present invention have been described above, it should be understood that they have been presented by way of illustration and example only, and not limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the appended claims and their equivalents. It will also be understood that each feature of each embodiment discussed herein, and of each reference cited herein, can be used in combination with the features of any other embodiment. All patents and publications discussed herein are incorporated by reference herein in their entirety.

What is claimed is:

1. An accessory bag for exchanging lenses of an SLR or DSLR camera, the bag comprising:

a main body portion including a first side panel, a second side panel, a back panel, an openable fold-over front panel, and a bottom panel which collectively define an enclosed interior volume, wherein the main body portion includes a closed configuration and an open configuration; and an expandable housing coupled to the main body portion via a built-in sliding mechanism, the expandable housing including a divider panel partitioning the expandable housing into a first compartment and a second compartment; wherein the expandable housing includes a collapsed configuration with the main body portion in the closed configuration such that both the first compartment and the second compartment are enclosed within the interior volume of the main body portion with one of the first compartment and the second compartment sized and shaped to house a lens of the SLR or DSLR camera and the other of the first compartment and the second compartment collapsed against the one of the first compartment and the compartment such the other of the first component and the second compartment cannot hold a lens; and such that the expandable housing has a first volume in the collapsed configuration that is approximately equal to a volume of one of the first compartment and the second compartment of the expandable housing and wherein the expandable housing includes an expanded configuration with the main body portion in the open configuration, wherein in the expanded configuration both of the first compartment and the second compartment are sized and shaped such that each can simultaneously house a lens of the SLR or DSLR camera.

2. The accessory bag of claim 1, wherein the divider panel extends midway through the expandable housing such that the volumes of the first and second compartments are approximately equal to each other with the expandable housing in the expanded configuration.

3. The accessory bag of claim 1, wherein the expandable housing further includes two opposing side panels connected to the front panel and wherein the two opposing side panels are connected to the back panel of the main body portion.

4. The accessory bag of claim 3, wherein the two opposing side panels of the expandable housing are formed of a foldable material such that sections of the side panels are configured to fold together in an accordion-like fashion when the expandable housing collapses into the main body portion.

5. The accessory bag of claim 1 wherein the expandable housing includes two opposing side panels coupled at a first end to the back panel of the main body portion and a front panel coupled to the two opposing side panels of the expandable housing at a second end of the side panels, wherein the expandable housing is expandable out of and collapsible into the main body portion when the front panel of the main body portion is correspondingly opened or closed via the built-in sliding mechanism and wherein the front panel of the expandable housing is releasably coupled to the front panel of the main body portion via the built-in sliding mechanism.

6. The accessory bag of claim 5, wherein the divider panel is coupled to the two opposing side panels between the first end and the second end, wherein the first compartment of the expandable housing has a first interior volume defined by the back panel of the main body portion, first portions of the side panels of the expandable housing, and the divider panel, and wherein the second compartment of the expandable housing has a second interior volume defined by the divider panel, second portions of the side panels of the expandable housing, and the front panel of the expandable housing.

7. The accessory bag of claim 1, wherein the built-in sliding mechanism includes:

an elongated planar slider having two opposing ends coupled to a front panel of the expandable housing; and a retainer loop coupled to the front panel of the main body portion, the retainer loop including a first end coupled to the front panel adjacent the first side panel, a second end coupled to the front panel adjacent the second side panel, and a middle portion extending between the first end and the second end such that the middle portion is spaced from an inner surface of the front panel, wherein the planar slider is threaded through the retainer loop such that an outer surface of the planar slider faces the inner surface of the front panel and an inner surface of the planar slider faces the middle portion of the loop and the retainer loop is configured to slide along the planar slider when the front panel of the main body portion is opened or closed to correspondingly expand or collapse the expandable housing into the main body portion.

8. The accessory bag of claim 7, wherein one of the two opposing ends of the elongated planar slider is releasably coupled to the front panel of the expandable housing.

9. The accessory bag of claim 8, wherein the one end of the elongated planar slider is releasably coupled to the front panel of the expandable housing via a hook and loop fastener.

10. The accessory bag of claim 1, wherein the fold-over front panel is releasably coupled to the first side panel and the second side panel by a coupling mechanism such that the main body portion may be converted from the closed configuration to the open configuration by one-handed operation of the coupling mechanism.

11. The accessory bag of claim 10, wherein the coupling mechanism includes a first closure mechanism coupling a first edge of the front panel to the first side panel and a second closure mechanism coupling a second edge of the front panel to the second side panel.

12. The accessory bag of claim 11, wherein the first closure mechanism is a first zipper and the second closure mechanism is a second zipper, further including a strap coupling the first zipper and the second zipper such that the first zipper and the second zipper may be simultaneously operated.

* * * * *